United States Patent [19]

Bruenn et al.

[11] Patent Number: 4,958,780

[45] Date of Patent: Sep. 25, 1990

[54] SPOOL DRIVING AND BRAKING

[75] Inventors: Rainer Bruenn, Essel; Rolf Heisterhagen, Hanover; Wolfram Klebl, Isernhagen; Harry Staschewski, Langenhagen, all of Fed. Rep. of Germany

[73] Assignee: Kabelmetal Electro GmbH, Hanover, Fed. Rep. of Germany

[21] Appl. No.: 335,572

[22] Filed: Apr. 10, 1989

[30] Foreign Application Priority Data

Apr. 9, 1988 [DE] Fed. Rep. of Germany ..... 3811876

[51] Int. Cl.[5] ..... B65H 49/18; B65H 54/44; B65H 59/04

[52] U.S. Cl. ..... 242/47; 242/45; 242/156

[58] Field of Search ..... 242/47, 45, 54 R, 75.4, 242/75.5, 75.51, 156, 156.2

[56] References Cited

U.S. PATENT DOCUMENTS 4,748,310 5/1988 Aso et al. ..... 242/45

FOREIGN PATENT DOCUMENTS 189905 12/1922 United Kingdom ..... 242/45

*Primary Examiner*—Stanley N. Gilreath

*Attorney, Agent, or Firm*—Ralf H. Siegemund

[57] ABSTRACT

In combination with a spool upon which elongated stock such as ribbon, wire, thread etc. is to be wound and from which the elongated stock is to be unwound; an electromagnet with cooperating armature and a yoke; the device is to be selectively used as a brake and as a clutch. This is accomplished by a permanent air gap from 0.1 to 1.5 mm between the yoke and the armature to remain effective in the energized state. On application of a relatively high voltage to the electromagnet positive coupling obtains between the electromagnet and the armature and, therefore between a shaft connected to the electromagnet and the armature as thereafter being connected to the spool; for positive common rotation of these parts. Upon application of a lower voltage to the electromagnet, a brake force becomes effective between the electromagnet on one hand, plus armature and the spool subassembly on the other hand.

5 Claims, 1 Drawing Sheet

SPOOL DRIVING AND BRAKING

BACKGROUND OF THE INVENTION

The present invention relates to the braking of spools, bobbins or the like which are journaled for rotation and which carry elongated stock such as ribbon, wire, threads, cords and the like which elongated stock can be wound upon or paid from such a spool and whereby a torque transmitting connection can be made between such a spool, drum, bobbin or the like and a driven shaft so that on positive driving the empty spool elongated stock can be rewound onto it.

The braking of a spool as envisioned by the invention includes the utilization of the force exerted by an electromagnetic field for producing a brake torque and momentum whereby an armature is used in form of a metallic annulus or ring which can be moved against the force of a spring and is arranged on a flange side of the spool; a magnetic field is closed through that ring when a suitably positioned electromagnet is energized.

In many instances including textile machines, stranding machines, unstranding machines or the like it is necessary to brake spools from which elongated stock is paid. The stock as stated may be comprised of ribbons, wires, threads etc. The braking is primarily a slowdown action with the goal in mind that the stock as it is paid and run off under a constant or near constant tension. Absence of such constancy may lead on one hand into a beating and lateral deflection action which obtains under tension. While on the other hand excessive tension may lead to tearing of the stock.

Brakes are known e.g. through the German printed patent application 15 38 579 using an electromagnet to obtain the requisite brake force. In addition, on unwinding the overall effective spool radius decreases which is effective in a change of the rotational speed of the spool. An analogous indicator is the weight of the spool and all these factors are available as indicators to reduce e.g. the braking force in order to obtain constant tension conditions. However, cases exist which do not only require to slow down the spool as it is uncoiled but the brake should double up as a coupling if subsequently the coil or spool after having been empty is to be reused and fresh ribbon, wires etc. are wound onto the spool. Here the known structure may not be sufficient to cover the complete range of torque necessary for winding and coiling while on the other hand on uncoiling the force should be controlled in such a manner that interference from uncoiling obtains.

DESCRIPTION OF THE INVENTION

It is an object of the present invention to provide a new and improved way of braking spools of the type to which the invention pertains which permits transmission of torque on coiling and actuation as a brake proper on unwinding without having to compromise as to the obtained objective.

It is a specific object of the present invention to provide a new and improved brake for spools carrying elongated stocks such as ribbon, threads, wires etc. is to be unwound from the spool while providing a torque transmitting connection to a drive shaft permits refilling of the spool with fresh stock; and specifically an electromagnetic force is used to obtain braking torque through a spring biased metallic annulus cooperating with an electromagnet.

In accordance with the preferred embodiment of the present invention, the particular object is fulfilled by providing a permanent air gap between the armature ring and the yoke for the electromagnet which gap is preferably in the range of 0.1 to 1.5 mm, preferably 0.2–0.8 mm. This arrangement permits active operation during unwinding under utilization of a reduced energizing voltage of the electromagnet; a sufficiently large control range for the brake force available without ever encountering any jerking and positive holding of the armature ring and without any attempt that the coil and spool is suddenly halted. On the other hand the invention makes sure that in a passive operation and mode, the electromagnet functions as a clutch. During winding stock onto the spool a higher and full energizing voltage is applied to the magnet which then provides slippagefree transmission of the requisite torque upon the spool.

The invention can be realized in a relatively simple fashion. The device that is improved in accordance with the invention includes an armature and the air gap can be formed through shortening the magnetic flux path from the yoke of the electromagnet. For this then one will preferably set back the end face of the yoke when facing the armature ring and by the distance of that desired air gap and in relation to the friction and sliding surfaces of the electromagnet itself. Another possibility of realizing the invention is through the provision of a particular area is preferably as follows. The friction and sliding surfaces of the electromagnet facing the armature ring are covered by an insulating disk that is equal to the desired air gap. This permits in a simple fashion the exertion of the requisite control of the braking force during unwinding.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
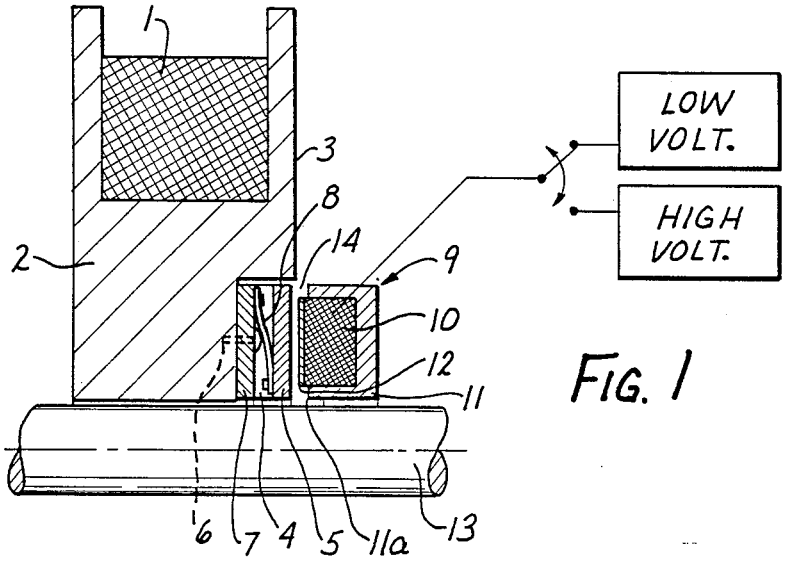
FIG. 1 is a cross section through detailed features for practicing the preferred embodiment of the present invention in a preferred mode configuration.

Proceeding now to the detailed description of the drawings, spools 2 are provided to carry many loops of wire 1 in each instance. Any such spool 2 has a front end 3 being provided with an indent 4 of annular configuration which is in fact the front end of the core of the spool. In this indent 4 an armature ring 5 is movably disposed, the movement is freely obtainable in axial direction except that a bolt connection 6 holds the armature ring 5 under specific utilization of a holding ring 7 connected to the bottom of the recess 4. The force transmitting connection between holding ring 7 on one hand and the armature ring 5 on the other hand obtains through leaf springs 8 connected to the rings 5 and 7 as illustrated.

An electromagnet 9 being likewise of annular configuration is arranged to face axially the armature ring 5. The electromagnet 9 is comprised of an energizing coil 10 and a trough shaped yoke 11 as well as friction and-/or slippage surface 12. The spool 2 is freely rotatably mounted on a shaft 13. This shaft pertains either to a winding and coiling machine or to a stranding machine or the like. The free rotation is obtained through conventional ball bearings which are not shown. Consequently armature ring 5 being fastened to the core 3 rotates as a spool rotates. On the other hand the electromagnet 9 is secured to the shaft 13 and therefore spool 2 does rotate relative to the electromagnet.

As the energizing coil 10 receives a first predetermined terminal voltage such as 24 volts the armature ring 5 is attracted for a short instant. If for any reason the spool 2 rotates it stops through this action. There is now maintained a positive force connection and force transmission between the shaft 13 and the electromagnet 9 secured thereto on one hand and the armature ring 5 on the other hand which is connected to the spool 2. This force connection between shaft 13 and spool 2 permits the shaft 13 to operate as a drive shaft and to wind wire, ribbon, thread etc. onto the spool body 2. This then is the operation in which the brake in fact functions as a coupling or clutch in the force and torque transmitting mode.

Subsequently the coil stock may be unwind from the spool 2. For example, the wire, ribbon or the like on the spool are to be fed to a stranding machine or they may themselves be stranded and have to be unstranded. Here now the full energization of the electromagnet 9 ceases and there may be no force transmission into the armature ring 5. This of course means that the spool 2 is allowed to freely rotate on the relatively stationary shaft 13 without impediment whatever.

Now in order to provide a rotational speed control for the spool 2 it may be necessary or even desirable to exert a controllable brake force on the spool. This situation arises during unwinding simply on account of a reduction in weight that is mass as well as a change in effective diameter of the spool. Both factors change the momentum of inertia of this spool, and, other situations being equal, the torque as exerted is changed through this change in condition. A control therefore is needed in order to make sure that the unwinding of the stock is carried out without interference and for this the device is used as a controllable brake. However as a prerequisite in accordance with the invention it is believed to be necessary to provide an air-gap such as 14.

This gap is instrumental in obtaining a uniform brake force of the coil 2 during unwinding of the stock from the spool provided a reduced second predetermined energization voltage is supplied to the electromagnet preferably not exceeding 6 V or below. This air-gap 14 will not interfere with the force transmission between shaft 13 and spool 2 on winding of stock as was described above, and when fully rated voltage is applied to coil 10.

In the particular embodiment shown the air-gap 14 obtains through recessing the yoke 11 of the magnet such as milling off material in the yoke front face. In other words the face 11*a* is recessed from the abutment surface 12 by that gap 14. This is shown specifically in FIG. 1. FIG. 2 now illustrates utilization of equipment shown in FIG. 1 in a stranding or unstranding machine wherein e.g. the stranding body and the stock in store for the stranded goods are structurally combined in the unit and are in effect duplicate for purposes of complex stranding. The stranding body in this case may be a tube 15 which is concentrically arranged to the spools 2. The tube revolves about the spools. A frame or stand 16 holds the entire equipment and transmission 17 provides for the requisite torque.

A freely rotatable hollow shaft 18 receives the coils and spools 2. As the tube 15 revolves the stranding elements 19 are taken off the respective spool. These stranding elements run on or in the tube and are constituted e.g. of individual wires. The wires are deflected by a guide disk 20 and fed to a stranding point 21. This is one way of operating. Alternatively elements 19 may not necessarily be stranded together but stranded onto an existing core. In this case the core is fed through the hollow shaft 18 to the stranding point 21.

As shown specifically in the elevational view of FIG. 2 two devices 22 and 23 and respectively being comprised of a stranding body and of coils are arranged in a plane so as to be situated one next to the other one. The two units are identical in construction, and through a displacing device being a part of frame 16, the two units 22 and 23 can be pivoted in a revolver like fashion. In a concrete situation this means that following the emptying of the spools 2 of the unit 22 that unit is taken out of the operating position while unit 23 is put into the operating position and the operation resumes. In the meantime the empty spools from the unit 22 have to be refilled and for this the loading station 24 is provided wherein suitably stored stranding elements such as wires are made available. They may have different dimension in order to obtain a variable program depending on the desired result. Through a suitable particular feeding device 25 the spools 2 of the unit 22 are refilled. Loading may be carried out automatically just as pivoting the various units into and out of the requisite positions.

Figure 2:
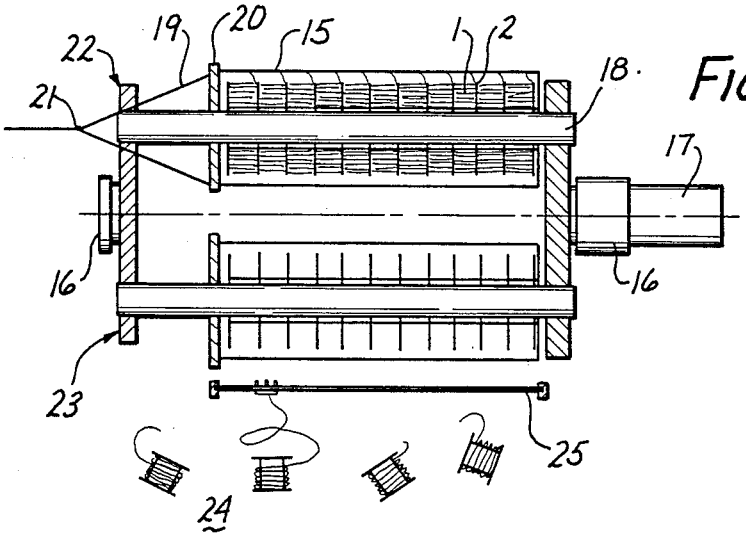
FIG. 2 illustrates application of the invention depicted in FIG. 1 in a particular case.

In all these instances each of the numerous spools 2 is constructed as shown in FIG. 1 i.e. each has its own brake which on refilling the spool functions as a coupling.

Figure 3:
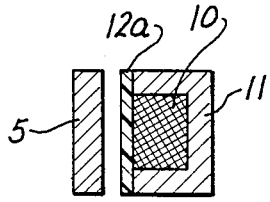
FIG. 3 illustrates a cross section through an alternative electromagnet structure.

As shown in FIG. 3 and deviating from the specific example shown in FIG. 1, the gap may be obtained through an insulating disk 12*a* between the electromagnet and the structure.

Generally speaking the invention is applicable to various fields and areas whereever windings, coilings, spooling, unwinding etc. is involved. This includes the stranding technology outlined above but involving specifically electrical cable, conductors or the like but it can be also be used in the textile industry. The cooperation with the stranding machine however is in fact a preferred mode of application. Known structure for stranding can be shown in German printed application 36 09 146. Here the ribbon stranding element and the ribbon, spool unit as described are provided in a duplicate fashion in order to work with one and refill the other. This approach has been taken over presently but now in one case i.e. when the spools in unit 23 are on line the respective spool brakes function as such i.e. as brakes in a manner described while the refilling of the spools in unit 22 uses these respective electromagnetic devices as coupling element.

It was mentioned above that the various kinds of stock can be accommodated since the machine being a stranding machine is an expensive piece of equipment and should be used in a versatile fashion for different tasks and purposes. Therefore the particular unit can be refilled with different kinds of elongated stock, different length, cross sections, different kinds of material and so forth to be subjected to the stranding. The operation is not interfered with and in each instance it is very helpful that the operation uses the same kind of equipment. A particular brake on unwinding that doubles up as a coupling on winding stock onto the same spool.

The invention is not limited to the embodiments described above but all changes and modifications thereof, not constituting departures from the spirit and scope of the invention, are intended to be included.

We claim:

1. In combination with a spool upon which elongated stock such as ribbon, wire, thread etc. is to be wound and from which the elongated stock is to be unwound; an electromagnetic device including an electromagnet and a cooperating armature, further including a yoke that is part of the electromagnet, the device is to be used selectively as a brake and as a clutch, the improvement comprising:

a shaft connected to the electromagnet for rotation therewith, the spool being rotatably arranged around the shaft;

means for connecting the armature to the spool for rotation with the spool, while permitting axial displacement of the armature relative to the spool;

means defining a permanent, magnetically effective gap between said yoke and said armature to remain effective as a gap in the energized state of the electromagnet;

means for applying a first, predetermined and relatively high voltage to the electromagnet so that positive coupling obtains between the electromagnet and the armature and therefore between said shaft as connected to the electromagnet; and the armature as being connected to the spool, whereby rotation of the shaft rotates the spool, and means for applying a second predetermined voltage, lower than the first voltage, to the electromagnet so that a brake force becomes effective between the electromagnet and the shaft on one hand, and the armature with the spool on the other hand.

2. Improvement as in claim 1, said gap being between 0.1 and 1.5 mm.

3. The improvement as in claim 1, the gap being between 0.2 and 0.8 mm.

4. The improvement as in claim 1, the gap is obtained by spacing a front end of the yoke from said armature.

5. The improvement as in claim 1, including an insulating disk interposed between the armature and ends of the yoke facing the armature and forming said gap.

* * * * *